US012005293B2

(12) United States Patent
Kassa

(10) Patent No.: US 12,005,293 B2
(45) Date of Patent: Jun. 11, 2024

(54) FITNESS WEIGHTS DEVICE

(71) Applicant: Frewoini Kassa, Sausalito, CA (US)

(72) Inventor: Frewoini Kassa, Sausalito, CA (US)

( * ) Notice: Subject to any disclaimer, the term of this patent is extended or adjusted under 35 U.S.C. 154(b) by 219 days.

(21) Appl. No.: 17/745,220

(22) Filed: May 16, 2022

(65) Prior Publication Data

US 2023/0129601 A1 Apr. 27, 2023

Related U.S. Application Data

(60) Provisional application No. 63/271,367, filed on Oct. 25, 2021.

(51) Int. Cl.

| | |
|---|---|
| ***A63B 21/072*** | (2006.01) |
| ***A63B 21/06*** | (2006.01) |
| ***A63B 21/075*** | (2006.01) |

(52) U.S. Cl.

CPC ..... *A63B 21/0726* (2013.01); *A63B 21/0602* (2013.01); *A63B 21/075* (2013.01); *A63B 2220/17* (2013.01); *A63B 2225/62* (2013.01); *A63B 2225/74* (2020.08)

(58) Field of Classification Search

CPC ..... A63B 21/0601; A63B 21/0602; A63B 21/0603; A63B 21/0606; A63B 21/072; A63B 21/0726; A63B 21/0728; A63B 21/075; B63B 2225/74

See application file for complete search history.

(56) References Cited

U.S. PATENT DOCUMENTS

| | | | | |
|---|---|---|---|---|
| 812,144 | A * | 2/1906 | MacKenzie | A63B 21/075 482/108 |
| 5,087,032 | A * | 2/1992 | Gresh | A63B 21/4035 482/50 |
| 5,242,349 | A * | 9/1993 | Reiff | F41B 15/027 463/47.4 |
| 10,434,359 | B2 * | 10/2019 | Feng | A63B 21/0603 |
| 2005/0043110 | A1 * | 2/2005 | Lindsey | A63B 60/06 473/300 |
| 2005/0065001 | A1 * | 3/2005 | Su | A63B 21/075 482/106 |
| 2017/0259108 | A1 * | 9/2017 | Feldstein | A61B 5/6895 |

* cited by examiner

*Primary Examiner* — Zachary T Moore
(74) *Attorney, Agent, or Firm* — Brennan, Manna & Diamond, LLC

(57) ABSTRACT

The present invention relates to a novel fitness weight device designed to allow users to customize dumbbell weights by filling the air chambers with air. The device comprises a dumbbell-styled weight with an inflatable air chamber. The devices can be inflated via a push button. Users can inflate the dumbbell devices to a desired weight for customized workouts. Once finished, the user can activate the air release valve to compact or retract the dumbbell for storage.

19 Claims, 3 Drawing Sheets

FITNESS WEIGHTS DEVICE

CROSS-REFERENCE TO RELATED APPLICATION

The present application claims priority to, and the benefit of, U.S. Provisional Application No. 63/271,367, which was filed on Oct. 25, 2021 and is incorporated herein by reference in its entirety.

FIELD OF THE INVENTION

The present invention relates generally to the field of fitness weight devices. More specifically, the present invention relates to an improved fitness weight device that allows users to customize the weight of the dumbbell by filling an air chamber with air. The device comprises dumbbell-style weights with an inflatable air chamber. Accordingly, the present disclosure makes specific reference thereto. Nonetheless, it is to be appreciated that aspects of the present invention are also equally applicable to other like applications, devices and methods of manufacture.

BACKGROUND

By way of background, standard dumbbell weights are available in a single size and are difficult to transport. Typically, the weights must remain on a rack for storage and are unable to be transported away from home or the gym. Users who desire to workout away from home may be unable to perform desired exercises requiring dumbbell weights. Thus, an adjustable dumbbell would be useful for users desiring to workout away from the home and/or gym.

Furthermore, prior art adjustable dumbbell weights typically require multiple weights, locking collars, and plates, wherein the multiple weights are accessed via a pin. Adjustable dumbbells are the most space and cost efficient exercise equipment, however, they are not without some drawbacks. One drawback is the time it takes to change or adjust both dumbbells. Removing and replacing the locking collars and plates is time consuming and can be a potential safety hazard if the collars are not securely tightened. Another drawback is that it is difficult to perform certain exercises, such as bench presses, inclines and shoulder work with the clutter of loose weights. Thus, there is still a need for an adjustable dumbbell of improved construction which is not only compact in size, but also easily and securely adjustable and comfortable to use without the clutter of loose weights.

Therefore, there exists a long-felt need in the art for a fitness weight device that allows users to customize the dumbbell weight by filling the air chamber with air. There is also a long-felt need in the art for a fitness weight device that provides users with improved workout equipment designed to inflate or retract. Further, there is a long-felt need in the art for a fitness weight device that comprises a button used to release air from the chamber to compact or retract the weight for storage. Moreover, there is a long-felt need in the art for a device that includes LED lights to facilitate workouts in dimly lit environments. Further, there is a long-felt need in the art for a fitness weight device that offers a more convenient weight system for exercising at home, while traveling, etc. Finally, there is a long-felt need in the art for a fitness weight device that provides a simple and convenient workout in any location.

The subject matter disclosed and claimed herein, in one embodiment thereof, comprises a fitness weight device. The device is designed to allow users to customize the weight of the dumbbell by filling the air chamber with air. The device comprises a dumbbell-styled weight with an inflatable air chamber. The device can be inflated via a push button. Users can inflate the dumbbell device to a desired weight for customized workouts. Once finished, the user can activate the air release valve to compact or retract the dumbbell for storage. Further, there are LED lights on the devices for illumination and increased visibility in dimly lit workout areas. The devices can also include a built-in rep counter to track reps and Bluetooth capability.

In this manner, the fitness weight device of the present invention accomplishes all of the foregoing objectives and provides users with a device that offers a more convenient and simple weight system for exercising in any location. The device allows a user to customize the dumbbell devices via inflating or deflating air chambers. The device eliminates the need for multiple dumbbells of differing weights and offers a way for users to utilize only one set of adjustable dumbbells.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a fitness weight device. The device offers users a more convenient and simple weight system for exercising in any location. The device comprises a dumbbell-styled weight with an inflatable air chamber. The device can be inflated via a push button. Users can inflate the dumbbell device to a desired weight for customized workouts. Once finished, the user can activate the air release valve to compact or retract the dumbbell for storage.

In one embodiment, the fitness weight device comprises a dumbbell component that includes a handle and a pair of weight members, each of which is attached to one of two opposite ends of the handle. Specifically, the handle includes a pair of longitudinally spaced apart ends interconnected by a generally centrally located grip. The grip is shown in a position substantially coincident with the center of gravity of the dumbbell component, however, if desired, an alternate offset mounting position can be provided in order to create some leverage so as to effectively increase the training resistance.

In another embodiment, the handle includes a resilient shell that defines an inner chamber, and air is contained in the inner chamber that has shock-absorbing and weighting properties. The shell is made of a resilient material, such as rubber, thereby imparting the shell with deformable and shape-restorable properties. In this embodiment, the shell includes an inner lining layer defining the inner chamber, an outer skin layer enclosing and protecting the inner lining layer to enhance the strength of the shell. Moreover, while the shell is in the shape of a cylinder with a wall thickness of at least 2 mm in this embodiment, the shape of the shell is not limited thereto in other embodiments of the invention. Furthermore, the number of layers included in the shell can vary depending on actual requirements, e.g., the desired resilience and strength and the cost of the weight member.

Suitable materials for forming the shell include resilient plastic, polyurethane, thermoplastic rubber, and polyvinyl chloride, etc.

In one embodiment, air is introduced into the inner chamber via a hole that extends through the shell and into the inner chamber. A stopper is used to close the hole. The stopper of each handle and/or weight member is configured with an air inflation hole that permits filling a suitable amount of air into the inner chamber via an air inflating pin for improving resiliency and increased weight of the handle and/or weight member. Further, once filled, a user can activate the air release valve to release the air and to compact the dumbbell device for storage.

Through the use of the shell and the inner chamber filling with air, a customizable, desired weight for the handle and the weight member can be achieved through the addition of air in appropriate proportions, thereby dispensing with the need to use different weights when exercising.

In one embodiment, the handle is connected integrally to the outer skin layers of the shells of the weight members. While the weighted members are shown to be solid in this embodiment, the weighted members may be hollow and may be in spatial communication with the inner chambers of the handle in other embodiments of the invention. Further, each weight member can include a resilient shell that defines an inner chamber. The inner chamber is typically filled with air, as the handle is.

In another embodiment, a coupling seat is fixed to an outer surface of the shell of each weight member for threaded coupling with the handle. However, other coupling mechanisms may be employed between the shell and the handle in other embodiments of this invention.

In one embodiment, other materials can be inserted into the inner chamber for weight bearing properties, such as, but are not limited to, water, sand, iron sand, natural ore powder, pebbles, etc.

In this embodiment, aside from choosing weight members having a desired weight characteristic, it is possible to attach more than two weight members to the handle in order to achieve a desired exercising effect.

In one embodiment, the handle component comprises a textured grip to help a user grasp the weight during exercise. Further, the handle component is preferably coated or surrounded by a sleeve of foam material for comfort.

In one embodiment, the fitness weight device comprises a plurality of LED lights positioned around the body of the device for illumination and increased visibility in dimly lit workout areas.

In another embodiment, the fitness weight device comprises a built-in rep counter to track reps while exercising.

In yet another embodiment, the fitness weight device comprises Bluetooth capability and is in communication with a wireless communication module and smart device. Thus, the dumbbell devices can be controlled (i.e., inflated or deflated) via a user's smartphone.

In another embodiment, the fitness weight device comprises a plurality of indicia on the dumbbell component and/or the handle.

In one embodiment, the fitness weight device comprises a kettlebell, and includes a generally ball-shaped weight member and a handle having opposite ends secured to the resilient shell of the weight member using any suitable manner known in the art. The handle may be a rigid handle or a flexible handle. Typically, the weight member is configured to permit filling of air into the inner chamber of the shell via an air inflating pin in a manner similar to that stated supra.

In yet another embodiment, a method of utilizing customizable dumbbell weights to facilitate simple and convenient workouts in any location is described. The method includes the steps of providing at least one dumbbell device comprising a dumbbell-styled weight and inflatable air chamber. The method also comprises inflating the dumbbell device to a desired weight for customized workouts. Further, the method comprises, once finished, activating the air release valve to compact the dumbbell device for storage. Finally, placing the dumbbell device in a desired storage and/or transportation area.

Numerous benefits and advantages of this invention will become apparent to those skilled in the art to which it pertains, upon reading and understanding the following detailed specification.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figure 1:
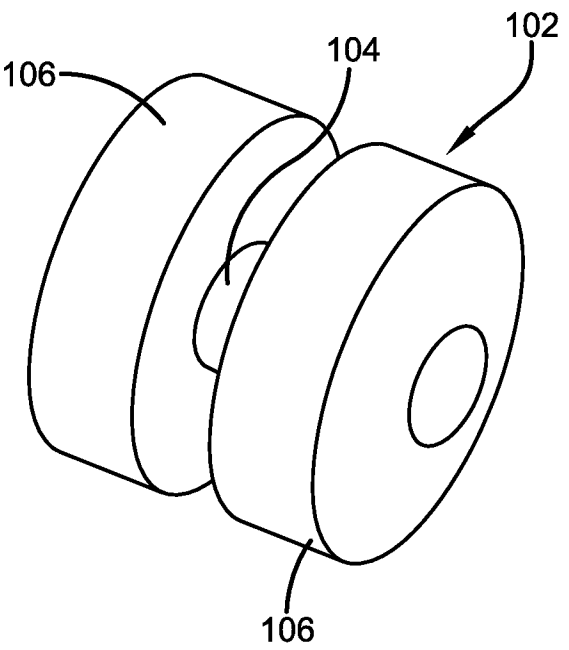
FIG. 1 illustrates a perspective view of one potential embodiment of the fitness weight device of the present invention in both an inflated stated and ready for use and in a deflated state for compact storage in accordance with the disclosed architecture.
Figure 1:
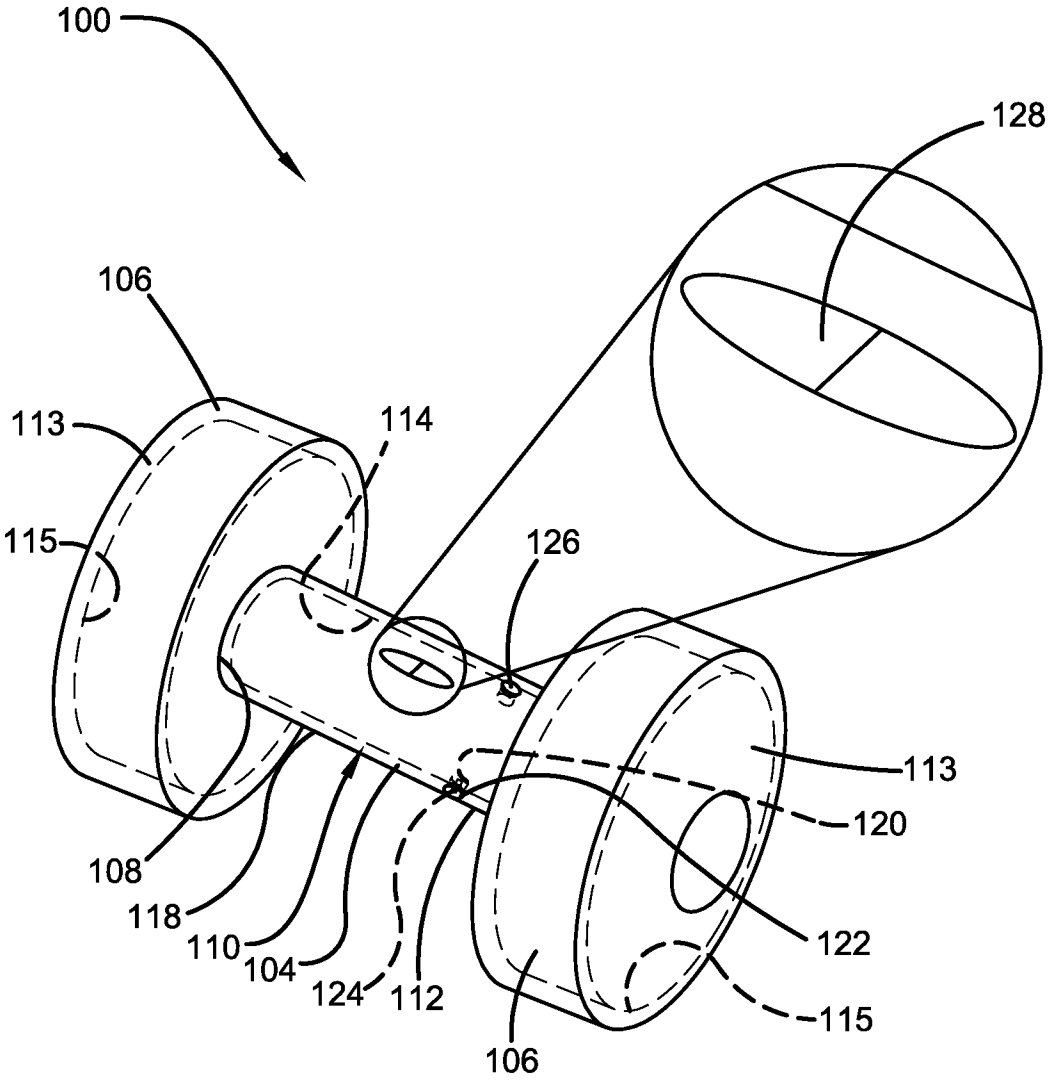

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long-felt need in the art for a fitness weight device that allows users to customize dumbbell weights by filling the air chambers with air. There is also a long-felt need in the art for a fitness weight device that provides users with improved workout equipment designed to inflate or retract. Further, there is a long-felt need in the art for a fitness weight device that comprises a button used to release air from the chamber to compact or retract the weight for storage. Moreover, there is a long-felt need in the art for a device that includes LED lights to facilitate workouts in dimly lit environments. Further, there is a long-felt need in the art for a fitness weight device that offers a more convenient weight system for exercising at home, while traveling, etc. Finally, there is a long-felt need in the art for a fitness weight device that provides a simple and convenient workout in any location.

The present invention, in one exemplary embodiment, is a novel fitness weight device comprising a dumbbell-styled weight with an inflatable air chamber. The device can be inflated via a push button. Users can inflate the dumbbell device to a desired weight for customized workouts. Once finished, the user can activate the air release valve to compact or retract the dumbbell for storage. The present invention also includes a novel method of utilizing customizable dumbbell weights to facilitate simple and convenient workouts in any location. The method includes the steps of providing at least one dumbbell device comprising a dumbbell-styled weight and inflatable air chamber. The method also comprises inflating the dumbbell device to a desired weight for customized workouts. Further, the method comprises, once finished, activating the air release valve to compact the dumbbell device for storage. Finally, placing the dumbbell device in a desired storage and/or transportation area.

Referring initially to the drawings, FIG. 1 illustrates a perspective view of one embodiment of the fitness weights device 100 of the present invention. In the present embodiment, the fitness weights device 100 is an improved dumbbell device that allows users to customize their dumbbell weights by filling the air chamber with air. The device 100 is especially designed to allow any suitable user as is known in the art, a more convenient and simple weight system for exercising in any location. More specifically, the device 100 comprises a dumbbell-styled weight with an inflatable air chamber. The device 100 can be inflated via a push button. Users can inflate the dumbbell device to a desired weight for customized workouts. Once finished, the user can activate the air release valve to compact or retract the dumbbell for storage.

In one embodiment, the fitness weight device 100 comprises a dumbbell component 102 that includes a handle 104 and a pair of weight members 106, each of which is attached to a respective one of two opposite ends 108 of the handle 104. Specifically, the handle 104 includes a pair of longitudinally spaced apart ends 108 interconnected by a generally centrally located grip 110. The grip 110 is shown in a position substantially coincident with the center of gravity of the dumbbell component 102, however, if desired, an alternate offset mounting position can be provided in order to create some leverage so as to effectively increase the training resistance.

In another embodiment, the handle 104 includes a resilient shell 112 that defines an inner chamber 114, and air is contained in the inner chamber 114 that has shock-absorbing and weighting properties. The shell 112 is made of a resilient material, such as rubber, thereby imparting the shell 112 with deformable and shape-restorable properties. In this embodiment, the shell 112 includes an inner lining layer 116 defining the inner chamber 114, an outer skin layer 118 enclosing and protecting the inner lining layer 116 to enhance the strength of the shell 112. Moreover, while the shell 112 is in a shape of a cylinder with a wall thickness of at least 2 mm in this embodiment, the shape of the shell 112 is not limited thereto in other embodiments of the invention. Furthermore, the number of layers included in the shell 112 can vary depending on actual requirements, i.e., the desired resilience and strength and the cost of the weight member 106.

Suitable materials for manufacturing the shell 112 include resilient plastic, polyurethane, thermoplastic rubber, and polyvinyl chloride, polypropylene or acrylonitrile-butadiene-styrene (ABS), or any other suitable material as is known in the art, such as, but not limited to, polyethylene, polyethylene terephthalate, polyvinyl chloride, polystyrene, etc. Generally, the fitness weight device 100 is also manufactured from a material that is water resistant or water permeable, or the shell 112 comprises a coating that is water resistant or water permeable.

In another embodiment, air is introduced into the inner chamber 114 via an air inflation hole 120 that extends through the shell 112 and into the inner chamber 114. A stopper 122 is used to close the air inflation hole 120. Specifically, the stopper 122 of each handle 104 and/or weight member 106 is configured with an air inflation hole 120 that permits filling a suitable amount of air into the inner chamber 114 via an air inflating pin 124 for improving resiliency and increased weight of the handle 104 and/or weight member 106. Further, once filled, a user can activate the air release valve 126 to release the air and to compact the dumbbell component 102 for storage.

A user fills the device 100 with air via pressing the inflate/deflate button 128. Thus, through the use of the shell 112 and the inner chamber 114 filling with air, a customizable, desired weight for the handle 104 and the weight member 106 can be achieved through the addition of air in appropriate proportions, thereby dispensing with the need to use different weights when exercising. Furthermore, after use, the air can be released via pressing the inflate/deflate button 128 and the dumbbell component 102 compacted down for storage.

Figure 2:
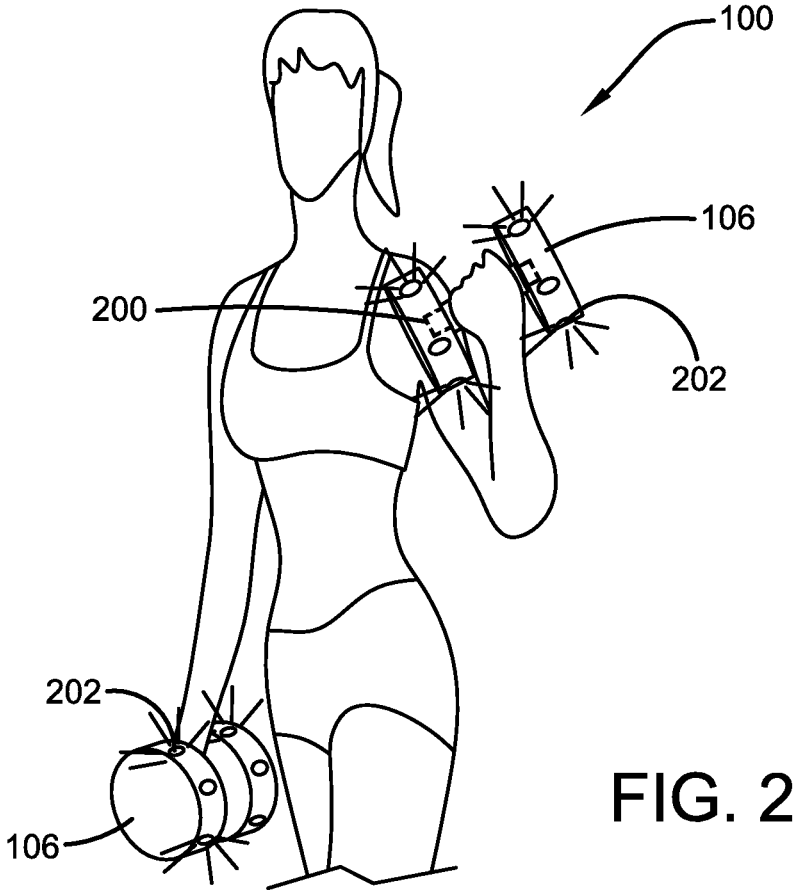
FIG. 2 illustrates a perspective view of another potential embodiment of the fitness weight device of the present invention in use and illuminated in accordance with the disclosed architecture.

FIG. 2 illustrates a perspective view of another embodiment of the fitness weight device 100 of the present invention. In this embodiment, the handle 104 is connected integrally to the outer skin layers of the shells of the weight members 106. While the weighted members 106 are shown to be solid in this embodiment, the weighted members 106 may be hollow and may be in spatial communication with the inner chambers of the handle 104 in other embodiments of the invention. Further, each weight member 106 can include a resilient shell 113 that defines an inner chamber 115. The inner chamber 115 is typically filled with air, as the handle 104 is.

In another embodiment, a coupling seat 200 is fixed to an outer surface of the shell 113 of each weight member 106 for threaded coupling with the handle 104. However, other coupling mechanisms may be employed between the shell 113 and the handle 104 in other embodiments of this invention.

In another embodiment, other materials can be inserted into the inner chamber 114 or 115 for weight bearing properties, such as, but are not limited to, water, sand, iron sand, natural ore powder, pebbles, etc., or any other suitable materials as is known in the art, depending on the needs and/or wants of a user.

In another embodiment, the fitness weight device 100 comprises a plurality of LED lights 202 positioned around the dumbbell component 102 for illumination and increased visibility in dimly lit workout areas. Any number of LED lights 202 can be utilized, depending on the needs and/or wants of a user. The LED lights 202 would typically be battery powered, and/or could be rechargeable and used via any other suitable powering means as is known in the art.

Figure 3:
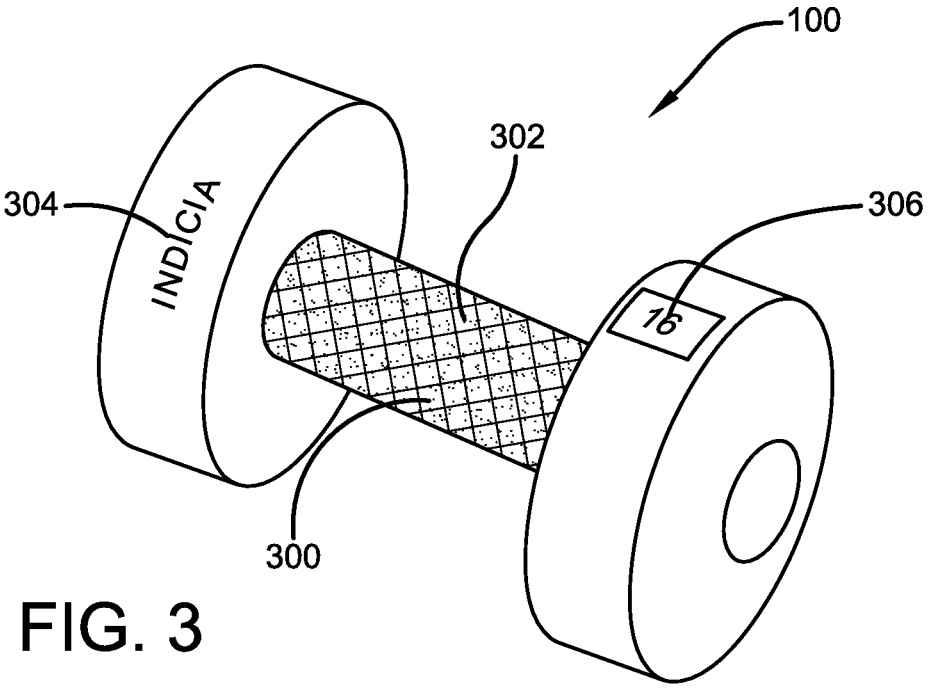
FIG. 3 illustrates a perspective view showing the rep counter of one potential embodiment of the fitness weight device of the present invention in accordance with the disclosed architecture.

FIG. 3 illustrates a perspective view of another embodiment of the fitness weight device 100 of the present invention. In this embodiment, aside from choosing weight members 106 having a desired weight characteristic, it is possible to attach more than two weight members 106 to the handle 104 in order to achieve a desired exercising effect, depending on the needs and/or wants of a user.

In another embodiment, the handle 104 comprises a textured grip 300, finger grooves, or other tactile components to help a user grasp the weight during exercise. Further, the handle 104 is preferably coated or surrounded by a sleeve of foam material 302 for comfort, or other suitable material as is known in the art. In some embodiments, the handle 104 can comprise both a textured grip 300 and a sleeve of foam material 302, depending on the needs and/or wants of a user.

Further, the fitness weight device 100 comprises a plurality of indicia 304 on the dumbbell component 102 and/or the handle 104. Specifically, the dumbbell component 102 may include advertising, a trademark, or other letters, designs, or characters, printed, painted, stamped, or integrated into the outer skin layer 118, or any other indicia 304 as is known in the art. Specifically, any suitable indicia 304 as is known in the art can be included, such as, but not limited to, patterns, logos, emblems, images, symbols, designs, letters, words, characters, animals, advertisements, brands, etc., that may or may not be fitness or weight/brand related.

In another embodiment, the fitness weight device 100 comprises a built-in rep counter 306 to track reps while exercising. The rep counter 306 can be positioned on the either weight member 106, or the handle 104, or any other suitable place on the dumbbell component 102 as is known in the art, depending on the needs and/or wants of a user.

Figure 4:
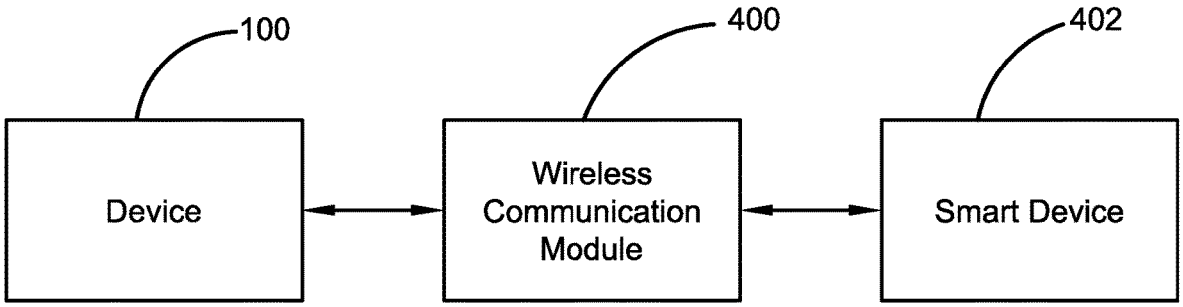
FIG. 4 illustrates a block diagram of the wireless communication module in communication with a smart device and one potential embodiment of the fitness weight device of the present invention in accordance with the disclosed architecture.

FIG. 4 illustrates a perspective view of another embodiment of the fitness weight device 100 of the present invention. In this embodiment, the fitness weight device 100 comprises Bluetooth capability and is in communication with a wireless communication module 400 and smart device 402. Thus, the dumbbell component 102 can be controlled (i.e., inflated or deflated) via a user's smartphone 402. Specifically, the wireless communications module 400 would allow the device 100 to pair with a mobile application on a smart device 402. Once paired, a user could control the fitness weight device 100 via the mobile application.

In another embodiment, the fitness weight device 100 comprises a kettlebell (not shown), and includes a generally ball-shaped weight member and a handle having opposite ends secured to the resilient shell of the weight member using any suitable manner known in the art. The handle may be a rigid handle or a flexible handle. Typically, the weight member is configured to permit filling of air into the inner chamber of the shell via an air inflating pin in a manner similar to that stated supra.

Figure 5:
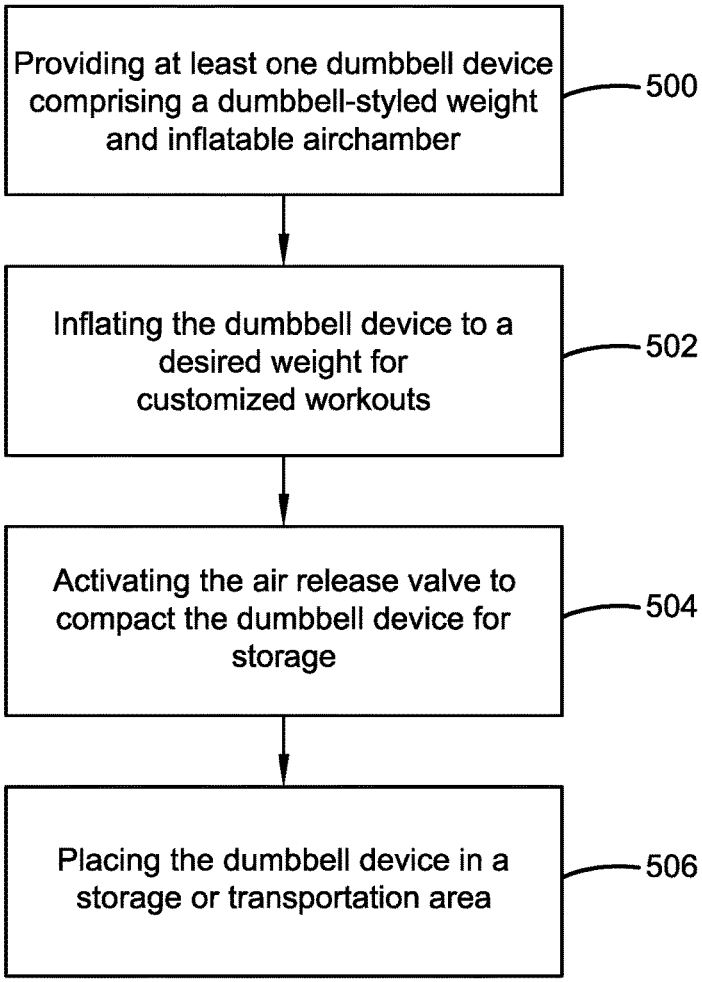
FIG. 5 illustrates a flowchart showing a method of utilizing the customizable dumbbell weights of the present invention to facilitate simple and convenient workouts in any location in accordance with the disclosed architecture.

FIG. 5 illustrates a flowchart of the method of utilizing customizable dumbbell weights to facilitate simple and convenient workouts in any location is described. The method includes the steps of at 500, providing at least one dumbbell device comprising a dumbbell-styled weight and inflatable air chamber. The method also comprises at 502, inflating the dumbbell device to a desired weight for customized workouts. Further, the method comprises at 504, once finished, activating the air release valve to compact the dumbbell device for storage. Finally, at 506, placing the dumbbell device in a desired storage and/or transportation area.

Certain terms are used throughout the following description and claims to refer to particular features or components. As one skilled in the art will appreciate, different users may refer to the same feature or component by different names. This document does not intend to distinguish between components or features that differ in name but not structure or function. As used herein "fitness weight device", "dumbbell device", and "device" are interchangeable and refer to the fitness weight device 100 of the present invention.

Notwithstanding the foregoing, the fitness weight device 100 of the present invention can be of any suitable size and configuration as is known in the art without affecting the overall concept of the invention, provided that it accomplishes the above-stated objectives. One of ordinary skill in the art will appreciate that the fitness weight device 100 as shown in FIGS. 1-5 is for illustrative purposes only, and that many other sizes and shapes of the fitness weight device 100 are well within the scope of the present disclosure. Although the dimensions of the fitness weight device 100 are important design parameters for user convenience, the fitness weight device 100 may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A fitness weight device that allows a user a more convenient and simple weight system for exercising in any workout location, the fitness weight device comprising:

a dumbbell component comprising a handle and a pair of weight members;

wherein each of the pair of weight members is attached to opposite ends of the handle;

wherein the handle comprises a shell that defines an inner chamber;

wherein a quantity of air is pumped into or out of the inner chamber;

further wherein the user can customize a weight of the dumbbell component; and an inflate/deflate button that allows the inner chamber to fill with the quantity of air, or release the quantity of air from the inner chamber.

2. The fitness weight device of claim 1, wherein the handle comprises a grip.

3. The fitness weight device of claim 2 wherein the grip is textured for easy grasping by the user.

4. The fitness weight device of claim 2, wherein the grip comprises a sleeve of foam material.

5. The fitness weight device of claim 1, wherein the shell comprises an inner lining layer that defines the inner chamber and an outer skin layer that encloses and protects the inner lining layer.

6. The fitness weight device of claim 5, wherein the shell comprises an air inflation hole that extends through the shell and into the inner chamber.

7. The fitness weight device of claim 6, wherein a stopper is used to close the air inflation hole.

8. The fitness weight device of claim 7, wherein the stopper is sized and configured to correspond with the air inflation hole and air inflating pin for filling the inner chamber with the quantity of air.

9. The fitness weight device of claim 8, wherein the stopper comprises an air release valve to release the quantity of air from within the inner chamber.

10. The fitness weight device of claim 1 further comprising a plurality of LED lights positioned around the dumbbell component.

11. The fitness weight device of claim 1 further comprising a plurality of indicia on the dumbbell component.

12. The fitness weight device of claim 1 further comprising a built-in rep counter to track a number of reps performed by the user with the dumbbell component.

13. A fitness weight device that allows a user a more convenient and simple weight system for exercising in any workout location, the fitness weight device comprising:

a dumbbell component comprising a handle and a pair of weight members;

wherein each of the pair of weight members is attached to opposite ends of the handle;

wherein the handle comprises a shell that defines an inner chamber and a quantity of air may be pumped into or out of the inner chamber;

wherein the shell comprises an inner lining layer that defines the inner chamber and an outer skin layer that encloses and protects the inner lining layer;

wherein the shell comprises an air inflation hole that extends through the shell and into the inner chamber, and a stopper for closing the air inflation hole;

wherein the stopper is sized and configured to correspond with the air inflation hole and the air inflating pin for filling the inner chamber with the quantity of air, and an air release valve to release the quantity of air from within the inner chamber; and further wherein the user can customize a weight of the dumbbell component by pressing an inflate/deflate button.

14. The fitness weight device of claim 13 further comprising a short range wireless communication capability.

15. The fitness weight device of claim 14 further comprising a wireless communication module that is in communication with a smart device.

16. The fitness weight device of claim 13 further comprising a plurality of LED lights positioned around the dumbbell component.

17. The fitness weight device of claim 13 further comprising a plurality of indicia on the dumbbell component.

18. The fitness weight device of claim 13 further comprising a built-in rep counter to track a quantity of reps performed by the user with the fitness weight device.

19. A method of utilizing a customizable dumbbell weight to facilitate a simple and convenient workout in any workout location, the method comprising the steps of:

providing at least one dumbbell device comprising a dumbbell-styled weight and an inflatable air chamber;

inflating the inflatable air chamber of the at least one dumbbell device to a desired weight for a customized workout via an inflate button;

once finished with the customized workout, activating an air release valve via a deflate button to compact the at least one dumbbell device for storage; and placing the at least one dumbbell device in a desired storage or transportation area.

* * * * *